United States Patent [19]

Shimohira

[11] 4,253,506

[45] Mar. 3, 1981

[54] SPIRAL PLANE BIT AND ROTARY CUTTER INCORPORATING SAME

[76] Inventor: Koichi Shimohira, No. 4-5-2, Takanodai, Nerima-ku, Tokyo, Japan

[21] Appl. No.: 951,160

[22] Filed: Oct. 13, 1978

[30] Foreign Application Priority Data

Jun. 27, 1978 [JP] Japan ..... 53/88070[U]

[51] Int. Cl.[3] ..... B27C 1/00

[52] U.S. Cl. ..... 144/221; 144/117 R; 144/241; 407/63

[58] Field of Search ..... 144/114 R, 117 R, 162 R, 144/218, 221, 230, 241, 224, 225, 226, 227, 117 B; 407/62, 63, 12

[56] References Cited

U.S. PATENT DOCUMENTS

| | | | |
|---|---|---|---|
| 19,035 | 1/1858 | Mallary | 144/221 |
| 107,943 | 10/1870 | More | 144/221 |
| 512,463 | 1/1894 | Bechtol | 407/63 |
| 567,545 | 9/1896 | Munch | 144/221 |
| 811,768 | 2/1906 | Forbes | 144/221 |
| 841,439 | 1/1907 | Plue | 144/221 |
| 909,122 | 1/1909 | Roussell | 144/221 |
| 2,782,489 | 2/1957 | Hargrove et al. | 407/63 |
| 4,074,737 | 2/1978 | Stewart | 144/117 R |
| 4,131,146 | 12/1978 | Koch | 144/221 |

FOREIGN PATENT DOCUMENTS 2004266 8/1971 Fed. Rep. of Germany ..... 144/221

*Primary Examiner*—W. Donald Bray
*Attorney, Agent, or Firm*—Darby & Darby

[57] ABSTRACT

A rotary cutter is provided with a spiral plane bit which comprises a mounting plate extending spirally in the axial direction with a constant width, the mounting plate being made in such a manner that it is spirally cut out of a hollow cylinder with the inner radius of the mounting plate and a bit edge member extending also spirally along one lateral margin of the mounting plate and being fastened thereto, wherein there are provided a plurality of fastening holes arranged in the mounting plate in the longitudinal direction thereof, through which fastening elements extend radially into a plurality of threaded holes so as to fasten the mounting plate together with the said bit edge member on a rotary shank. This spiral plane bit is advantageously employed particularly for cutting wood material, because the spiral plane bit makes point contact with a workpiece of wood material and the contact point is displaced over the whole length of the spiral plane bit during cutting operation, resulting in smooth and uniform cutting with a less noise. The spiral bit edge is fastened to the mounting plate angularly displaceable so as to adjust the fastening position thereof.

10 Claims, 6 Drawing Figures

SPIRAL PLANE BIT AND ROTARY CUTTER INCORPORATING SAME

BACKGROUND OF THE INVENTION

The present invention relates to a spiral plane bit. More particularly, the invention relates to a spiral plane bit which can be mounted and fastened on the outer surface of a rotary shank for use in a rotary cutter of a planer or the like.

A conventional rotary cutter, for example the type which is mounted on a planer for cutting the surface of wood material, is constructed in such a way that the planing bit is fastened to the outer surface of a rotary shank. In the past, two general categories of such cutters have been available. In one type, a straight planing bit is inserted and secured in a straight groove extending parallel to the axis of the rotary shank, while in the other a spiral planing bit is inserted and fastened in a spiral groove formed on the outer surface of the rotary shank.

It is pointed out that the former rotary cutter, that is the straight type rotary cutter, has the drawback that it generates high noise during cutting operation because the planing bit makes contact with a workpiece over the whole length thereof at the same time and it tends to form an inverted grain on the surface of wood material. To eliminate this drawback, it is necessary to mount a supplementary cutter. The latter rotary cutter, that is spiral type rotary cutter, was originally developed in order to eliminate the drawbacks inherent in the conventional straight type rotary cutter. In a spiral plane cutter which has a length equal to one pitch of a spiral line, for instance, the plane bit comes in contact with the workpiece at just one point at all times, which generates less noise and consumes less power for the cutting operation. On the other hand, there is a drawback with the spiral plane bit in that uniform bit edge protrusion can only be achieved with much difficulty. The aforesaid "bit edge protrusion" means the protrusion of the spiral bit edge in a peripheral direction from the surface of the spiral groove in which the spiral bit edge is to be received. In case of a spiral plane bit with fixed pitch length, the bit is oriented in opposite directions at points half a pitch length apart. Hence, a bit edge protrusion in the peripheral direction on one side results in a bit edge retraction on the other side at a point half a pitch length away. This means that it is substantially impossible to provide a uniform bit edge protrusion over the whole length of the spiral plane bit and this is a critical drawback with the conventional spiral type rotary cutter. It has been found that the above-mentioned drawback with the hitherto known spiral plane bits results from the geometrical shape and structure of the plane bit itself.

SUMMARY OF THE INVENTION

The present invention is intended to eliminate the drawback with the hitherto known plane bits, as mentioned above. A spiral plane bit for a rotary plane cutter is proposed, according to the present invention, which comprises a mounting plate extending spirally along the bit with a constant width. The mounting plate is made in such a manner that it is spirally cut out of a hollow cylinder with the same inner radius as the mounting plate, and a bit edge member extends also spirally along one lateral margin or side corner of the mounting plate and is fastened thereto. A plurality of fastening holes are arranged in the mounting plate in the longitudinal direction thereof, and fastening elements extend radially through these holes into a plurality of threaded holes so as to fasten the mounting plate and the bit edge member on a rotary shank. To ensure bit edge protrusion, there are provided a second plurality of fastening holes in the mounting plate, which are located angularly apart from the first plurality of fastening holes. Corresponding to the second plurality of fastening holes, there are provided a second plurality of threaded holes on the rotary shank.

A spiral rotary cutter is provided with at least two spiral plane bits according to the present invention.

To fasten the spiral plane bit of the invention onto the rotary shank, set screw means is preferably employed. Typically a flat headed set screw is preferable, because its head portion may be adapted to sink below the surface of the mounting plate.

Preferably there is provided a relieving recess on the rotary shank on which the bit edge member is to be mounted, the relieving recess being located adjacent to the bit edge.

Further, there is preferably provided a relieving portion on the reverse side of the bit edge member so that wood chips are easily broken to very small length pieces.

It is a main object of the invention to provide a spiral plane bit which avoids the drawbacks inherent in the conventional plane bits. It is specifically contemplated that a plane bit have a bit edge which is easily adjusted to protrude in a peripheral direction, when it is mounted on the the rotary shank.

It is another object of the invention to provide a spiral plane bit which generates less noise during the cutting operation.

It is still another object of the invention to provide a spiral plane bit which ensures very smooth and uniform cutting of wood material.

It is still a further object of the invention to provide a spiral plane cutter which is simple to structure yet inexpensive to manufacture.

Other objects and advantages features of the invention will be available from the description and claims.

BRIEF DESCRIPTION OF THE DRAWINGS

The nature and characteristic features of the invention will be more readily understood from the following detailed description of presently preferred, but nonetheless illustrative, embodiments taken in connection with the accompanying drawings forming part thereof, in which.

DETAILED DESCRIPTION OF THE INVENTION

The invention is now described in detail with reference to the accompanying drawings which illustrate preferred embodiments of the invention.

Figure 1:
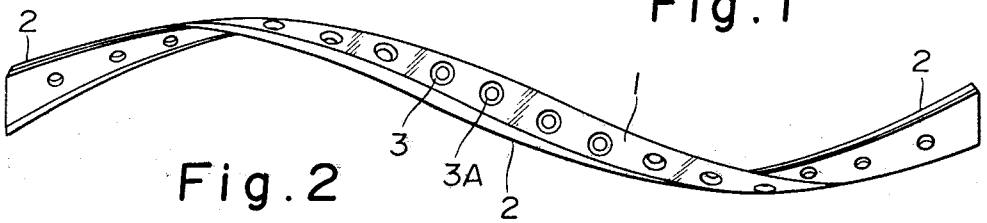
FIG. 1 is a side view of a spiral plane bit according to the present invention.
Figure 2:
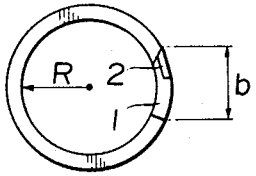
FIG. 2 is an end view of the spiral plane bit shown in FIG. 1.

Referring first to FIGS. 1 and 2, there is shown a spiral plane bit according to the invention, of which mounting plate 1 is made in such a form that it is spirally cut out of a hollow cylinder with an inner radius R and has a constant width b in its peripheral direction. Along the lateral margin, of the mounting plate 1, a bit edge member 2 extends in the longitudinal direction of the mounting plate and is preferably secured thereto by, for instance, soldering.

Further, the mounting plate 1 is provided with a plurality of holes 3 spaced along the longitudinal direction thereof, which are intended for fastening the mounting plate by means of screws, or the like. It is to be noted that the mounting plate 1 may be any length. In case of the illustrated embodiment of the invention, the mounting plate has a length equal to just one pitch of a spiral line.

Figure 3:
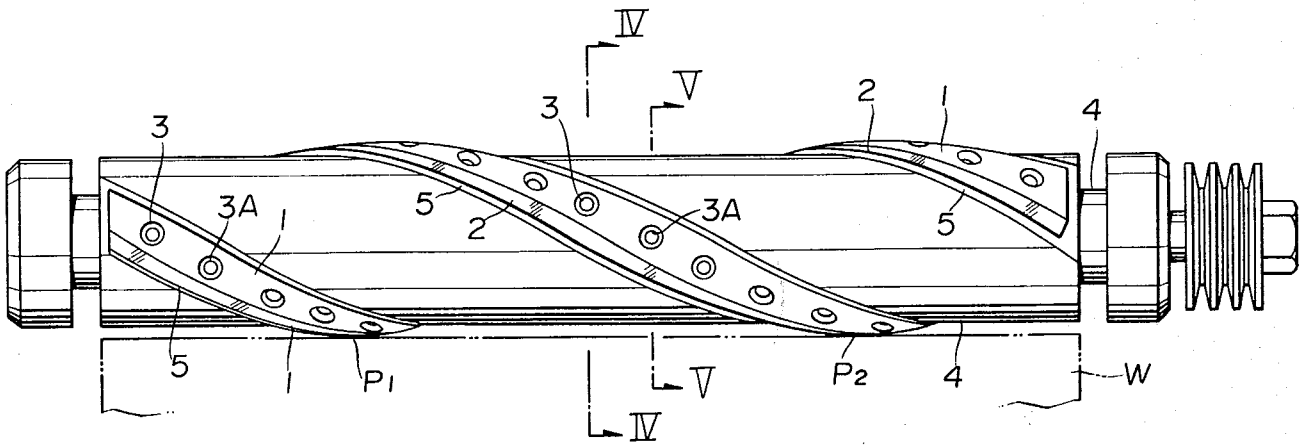
FIG. 3 is a side view of a rotary cutter having spiral plane bits of the invention mounted on a rotary shank.

As shown in FIG. 3, the plane bit according to the present invention is mounted on the outer surface of a rotary shank 4 (part of a rotary cutter) the radius of which is equal to the radius R of the spiral of the plane bit. The manner of mounting the plane bit is illustrated in FIG. 4: the plane bit is secured to the rotary shank 4 by inserting a plurality of fastening elements 6 through holes 3 into threaded holes 7 which extend in the rotary shank 4 in the radial direction, each fastening element 6 being preferably a flat head screw.

Figure 4:
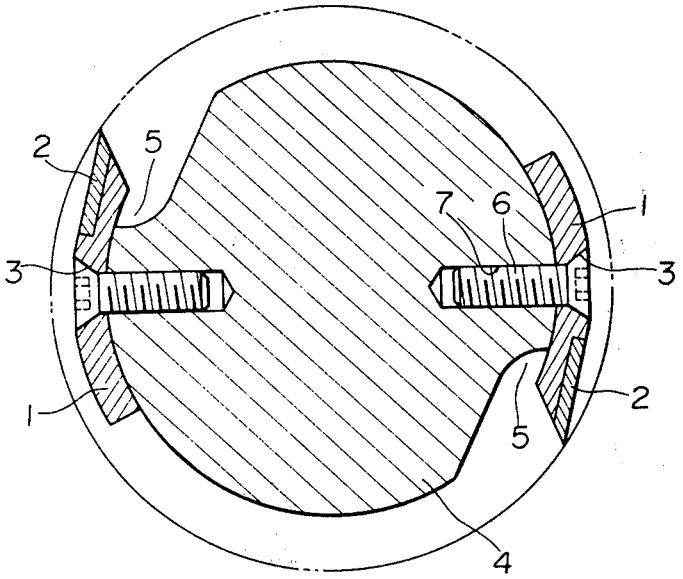
FIG. 4 is a cross sectional view of the rotary cutter taken along line IV—IV in FIG. 3, as shown in an enlarged scale.

It is preferable that two or three plane bits be mounted on the rotary shank 4 (in this case as illustrated in FIG. 4 the number is 2). It will be appreciated from FIGS. 4 and 5, however, that it is theoretically possible to mount that number of plane bits on the rotary shank 4 as is determined by dividing the circumference $2\pi R$ of the rotary shank by a number equal to the sum of (i) the width of the relieving recess 5 lateral to the elongated plane bit and (ii) the width of the plane bit itself. Each plane bit should, of course, have the same pitch.

Now, a bit edge protrusion for the plane bit according to the invention will be described. Prior to describing this, however, the fastening holes 3 on the mounting plate 1 will be described in detail. For each fastening hole 3, there is a respective fastening hole 3A which is spaced from the fastening hole 3 in the longitudinal direction. Further, there is provided another threaded hole 7A in the rotary shank 4 in an axial position to be opposite the fastening hole 3A. However, this threaded hole 7A is positioned so as to be angularly (circumferentially) displaced with respect to the threaded hole 7 (in the direction of the bit edge member 2) by an amount sufficient to provide the required bit edge protrusion. Assuming this angular displacement is $\theta$, the amount of bit edge protrusion is almost equal to $(R+t)\times\theta$ (where t denotes thickness of the mounting plate 1), so that a variety of bit edge protrusions can be assured by forming a plurality of threaded holes 7A, corresponding to each hole 3A, with various angular displacements $\theta$ from the threaded hole 7.

By virtue of the shape of mounting plate 1, the holes 3 and 3A lie on a common helical path. Inasmuch as each hole 3 has a corresponding hole 7 (i.e., the holes 3 and 7 define corresponding groups of holes), the holes 7 must also lie on a common helical path. Similarly, if the group of holes comprising holes 3A must align with the group of holes comprising holes 7A, holes 7A also lie on a common helical path. However, the helical path corresponding to the group of holes 7A is angularly (circumferentially) displaced with respect to the helical path corresponding to the group of holes 7. In the general case, where each hole 3A has a plurality of corresponding holes 7A, each of these holes being of progressively further angular displacement, there will be a plurality of groups of holes 7A, each group lying in a different helical path, the helical paths being of progressively increasing angular displacement from the helical path in which the holes 7 lie.

Figure 5:
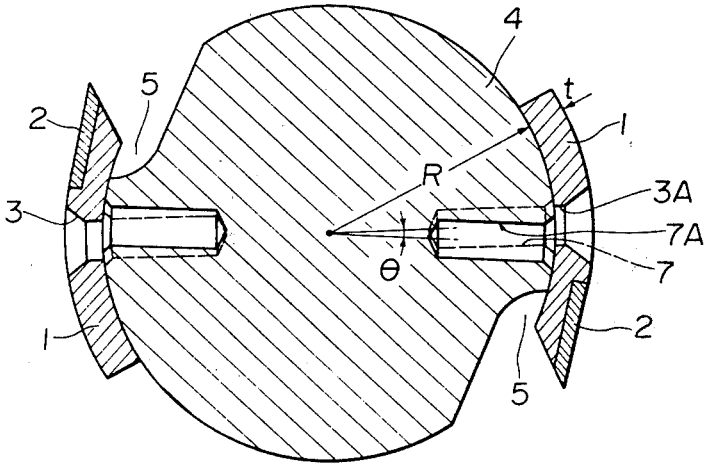
FIG. 5 is cross sectional view of the rotary cutter taken along line V—V in FIG. 3.

In the simplified embodiment shown in FIG. 5, the user may select bit edge protrusion by passing fasteners through either the corresponding groups of holes 3 and 7 or the corresponding groups of holes 3A and 7A. This provides two levels of selectivity in bit edge protrusion. However, in the general case where there are a plurality of holes 7A co-responding to each hole 3A, further selectivity in bit edge protrusion is possible by using the group of holes 3A and the group of holes 7A corresponding to a particular helical path defining the desired bit edge protrusion.

Figure 6:
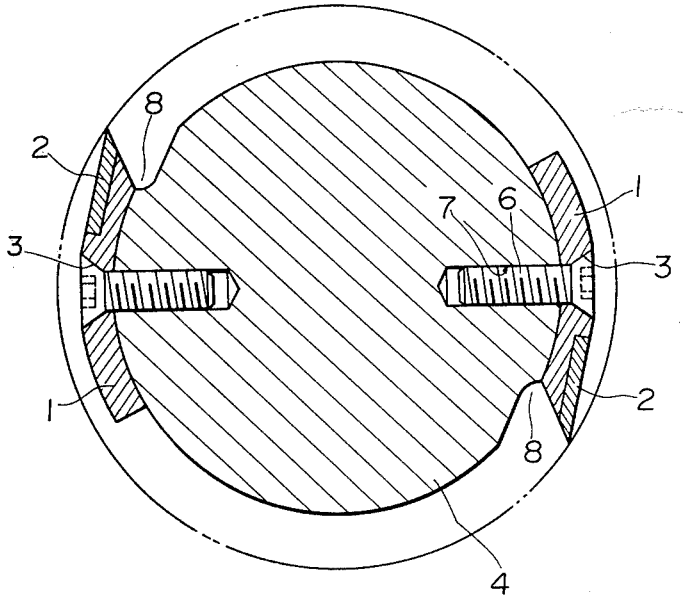
FIG. 6 is a cross sectional view of the rotary cutter similar to FIG. 4, showing another embodiment of the invention on which spiral plane bits according to the invention are mounted on the rotary shank.

As can be seen in FIGS. 4 and 6, the fasteners 6 pass freely through the holes 3 in mounting plate 1, but have a very close fit therein. This is intended to remove any substantial lateral movement of the fastener 6 within the hole 3. Thus, once the desired bit edge protrusion has been selected by appropriately mounting the plate to the shank, as explained above, the bit edge is essentially fixed with respect to the shank and there can be no appreciable change in the bit edge protrusion.

Further, there is provided a rotary cutter according to another embodiment of this invention, in which there is formed a relieving portion 8 on the rotary shank 4 on the reverse side of the bit edge member 2, the relieving portion 8 serving to facilitate expelling wood chips from the bit edge area. The plane bit according to this embodiment of the invention is mounted on the rotary shank 4, as illustrated in FIG. 6. It is an advantageous feature of this modified embodiment that, owing to the arrangement of the relieving portion 8, there is no need to make the relieving recess 5 as wide as illustrated in FIGS. 4 and 5. It is recognized that, with the aid of the relieving portion 8 formed adjacent to the bit edge member 2, wood chips are advantageously broken into short pieces and long continuous pieces are avoided.

Now, operation of a rotary cutter incorporating plane bits of the present invention will be described in detail.

In a rotary cutter with two spiral plane bits mounted on the rotary shank 4, and having a length equal to just one pitch of the spiral line, as illustrated in FIG. 3, the rotary cutter comes in contact with a workpiece W (shown in the broken lines) at the two points P1 and P2 at the same time. The contact points P1 and P2 are displaced along the length of the rotary shank 4 during one rotation thereof. If the plane bit has a length equal to two pitches, the rotary cutter makes contact with the workpiece at four points at the same time. Similarly, if there are mounted three plane bits having a length of one pitch, three point contact is obtained. As mentioned above, the cutting operation is performed in such a manner that the rotary cutter with the spiral plane bits mounted thereon according to the present invention comes in contact with the workpiece at a plurality of points, and as the rotary shank is rotated, the said contact points are displaced over the whole surface of the workpiece in the axial direction from one end to the other.

The typical characteristic features of the spiral plane bit according to the invention are as follows:

(I) less noise due to a smaller area where the spiral plane bit makes contact with the workpiece;

(II) less possibility of generating an inverted grain of wood due to the fact that during the cutting operation, the contact points are displaced in the axial direction when the rotary cutter is rotated; and (III) an easy and uniform bit edge protrusion which can be easily achieved in such a manner that the spiral plane bits are disconnected by unloosening the set screws, and displaced a little bit in the direction of rotation of the rotary shank and then tightened.

It should, of course, be understood the the description and drawings herein are merely illustrative and that various modification and changes can be made in the structure disclosed without departing from the spirit of the invention.

I claim:

1. In an improved rotary cutter for a workpiece, said cutter being of the type combining at least one spiral plane bit including a mounting plate of substantially uniform width formed in the shape of a spiral band having an inner face lying on a cylindrical surface of predetermined radium, said mounting plate having a plurality of fastening holes spaced therealong, and a bit edge at one lateral margin of said mounting plate; and a rotary shank on which said at least one bit is mounted, the improvement comprising:

said shank including a plurality of radially extending threaded bores arranged in groups, each group being positioned to be in registry with a number of said fastening holes, defining a respective group of said fastening holes when said at least one bit and said shank are in a predetermined, unique rotational angular relationship; and a plurality of screws each dimensioned to extend freely through one of said fastening holes with sufficiently close tolerance to avoid lateral movement of said screw therein, whereby any appreciable relative movement between said bit and said shank is eliminated, each screw extending through one of said fastening holes and being engaged in a respective one of said threaded bores;

the rotational angular relationship between said bit and said shank being adjustable by securing said bit to said shank so that said screws are engaged in a selected group of said threaded bores and extend through the group of fastening holes corresponding thereto, the optimum bit edge protrusion being thereby selected.

2. A rotary cutter as set forth in claim 1, wherein said spiral plant bit has a length equal to at least one pitch so that it comes in contact with the workpiece at one point which moves along said workpiece during rotation of said cutter.

3. A rotary cutter as set forth in claim 1, wherein at least two spiral plane bits are mounted on the rotary shank.

4. A rotary cutter according to claim 1 wherein each of said screws is a flat headed screw, said fastening holes in said mounting plate being countersunk.

5. A rotary cutter as set forth in claim 1 wherein all fastening holes in the mounting plate lie on a helical path.

6. A rotary cutter as set forth in claim 5, wherein each group of threaded bores on said shank lies on a helical path located angularly apart from the helical path connecting each other group of bores.

7. A rotary cutter as set forth in any of claims 2 or 3 wherein there are provided first and second groups of fastening holes in the mounting plate, which second group is located angularly apart from said first group of fastening holes so as to ensure the optimum bit edge protrusion.

8. A rotary cutter as set forth in claim 7, wherein there are provided a second group of threaded bores on said shank in registry with said second group of fastening holes.

9. A rotary cutter as set forth in claim 1, wherein there is provided a relieving recess on said rotary shank on which said bit edge member is to be mounted, said relieving recess being located adjacent to said bit edge member.

10. A rotary cutter as set forth in claim 1 wherein said rotary shank is provided with a relieving portion on the reverse side of said bit edge member and adjacent thereto, through which wood chips are easily broken into short pieces while the size of said relieving recess may be reduced.

* * * * *